US006764284B2

(12) United States Patent
Oehman, Jr.

(10) Patent No.: US 6,764,284 B2
(45) Date of Patent: Jul. 20, 2004

(54) PUMP MOUNT USING SANITARY FLANGE CLAMP

(75) Inventor: Robert E. Oehman, Jr., Raleigh, NC (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 10/325,610

(22) Filed: Dec. 19, 2002

(65) Prior Publication Data

US 2003/0129068 A1 Jul. 10, 2003

Related U.S. Application Data

(60) Provisional application No. 60/348,079, filed on Jan. 10, 2002.

(51) Int. Cl.[7] ..... F04B 17/00; F04B 35/00

(52) U.S. Cl. ..... 417/360; 417/289; 417/290

(58) Field of Search ..... 403/289, 290; 417/360, 423.6, 423.14, 423.15, 410.1, 420

(56) References Cited

U.S. PATENT DOCUMENTS

| | | | | |
|---|---|---|---|---|
| 2,047,330 A | | 7/1936 | Petersen | |
| 2,864,552 A | | 12/1958 | Anderson | |
| 2,911,170 A | | 11/1959 | Galin et al. | |
| 3,485,177 A | | 12/1969 | Clay | |
| 3,491,696 A | | 1/1970 | Howard | |
| 4,311,440 A | | 1/1982 | Eberhardt | |
| 5,165,867 A | * | 11/1992 | Dockery | 417/360 |
| 5,186,904 A | | 2/1993 | Lyzinski et al. | |
| 5,269,664 A | | 12/1993 | Buse | |
| 5,470,207 A | * | 11/1995 | Shockey et al. | 417/313 |
| 5,807,079 A | * | 9/1998 | Wilson | 417/360 |
| 6,036,452 A | | 3/2000 | Huang | |
| 6,135,726 A | | 10/2000 | Robertson et al. | |
| 6,168,393 B1 | | 1/2001 | Huber et al. | |
| 6,183,219 B1 | | 2/2001 | Nguyen et al. | |
| 6,276,908 B1 | * | 8/2001 | Batchelder et al. | 417/423.14 |
| 6,499,970 B1 | * | 12/2002 | Siegel et al. | 417/410.1 |
| 6,658,986 B2 | * | 12/2003 | Pitla et al. | 92/71 |

OTHER PUBLICATIONS

Tri–Clver, Inc: Technical Information, Fittings: Clamps and Nuts. Applicant requests the Examiner to consider this reference as prior art under 102(a), however, Applicants respectfully reserve the right to supplement this Information Disclosure Statement and take a contrary position should it be necessary.

* cited by examiner

*Primary Examiner*—Justine R. Yu
*Assistant Examiner*—William H. Rodriguez
(74) *Attorney, Agent, or Firm*—Christopher H. Hunter

(57) ABSTRACT

A metering assembly includes a motor removably coupled to a pump using a flange clamp. An annular connection flange is provided at one end of the motor housing; and a cooperating annular connection flange is provided at one end of the pump housing. The connection flanges have opposed, mating end surfaces which are located in flush relation with each other. The flange clamp includes a pair of arcuate clamping arms which are pivotally supported at one end, and a locking member connecting the other, distal free ends of the arms together, and which can be manually tightened and untightened, so that the flange clamp can be easily located around and tightened down around the annular connection flanges of the pump and motor to create a mechanical face seal between the pump and motor.

16 Claims, 4 Drawing Sheets

PUMP MOUNT USING SANITARY FLANGE CLAMP

CROSS-REFERENCE TO RELATED CASES

The present application claims the benefit of the filing date of U.S. Provisional Application Serial No. 60/348,079; filed Jan. 10, 2002, the disclosure of which is expressly incorporated herein by reference

FIELD OF THE INVENTION

The present invention relates generally to fluid metering assemblies, and more particularly to fluid pumps and motors for operating such pumps.

BACKGROUND OF THE INVENTION

In certain fluid transfer applications, a motor is removably mounted to a pump to operate the pump. The motor and/or pump are removably mounted to permit the pump and/or motor to be inspected and/or repaired. In many of these applications the pump is a self-contained unit and includes a housing, inlet and outlet ports, and a pump mechanism enclosed within the housing. One well-known pump mechanism is a gear pump with adjacent gears which accurately meter the fluid from the inlet to the outlet; The gears are mounted on a pair of journaled shafts, one of which is the drive shaft and extends outwardly from one end of the pump housing.

The motor can be any type of motor appropriate for the particular application, and in many applications also comprises a self-contained unit including a housing and a drive mechanism. A drive shaft is coupled to the drive mechanism and projects outwardly from one end of the motor housing. A coupling assembly couples the drive mechanism in the motor to the pump mechanism in the pump. One such coupling assembly includes a mechanical coupling between the drive shaft of the motor and the drive shaft of the pump. Another such coupling assembly comprises magnetic coupling components, which couple the drive mechanism of the motor to the pump mechanism of the pump without direct mechanical linkage. In any event, when the drive mechanism of the motor is rotated, the pump mechanism is operated to transfer fluid received in the inlet to the outlet.

Many techniques have been used to removably mount the pump to the motor, particularly to allow easy and simple inspection and removal. One common technique is to bolt the housing of the pump to the housing of the motor, such as shown in U.S. Pat. Nos. 6,183,219; 4,311,440; and 5,269,664. The bolts properly axially and concentrically align the pump with respect to the motor and provide a robust and firm attachment. While this is satisfactory in some applications, this technique usually requires a tool (such as a wrench) and significant time and labor to remove the bolts to uncouple/couple the motor. In other words, this technique can be labor intensive, which can increase the maintenance costs associated with operating the fluid system.

As such, it is believed there is a demand for an improved metering assembly having a pump removably coupled to a motor, where the pump can be simply and easily connected to and disconnected from the motor, and which minimizes the time and labor associated with changing out a pump.

SUMMARY OF THE PRESENT INVENTION

The present invention provides a novel and unique metering assembly which includes a pump removably mounted on a motor. The pump can be simply and easily mounted to and removed from the motor, which reduces the time and labor associated with repairing the pump. The mounting can advantageously be accomplished by hand—without the need for special repair tools.

According to the present invention, an annular connection flange is provided at one end of the housing (the end having the motor drive shaft); and a cooperating annular connection flange is provided at one end of the pump (the end having the pump drive shaft). The connection flanges have opposed, mating end surfaces which can be located in flush, sealing relation with each other; and preferably have beveled (or tapered) peripheral edges. When so mounted, a coupling assembly couples the drive mechanism of the motor to the pump mechanism of the pump.

To retain the pump to the motor, a flange clamp is used, preferably of the type commonly referred to as a "sanitary flange clamp". The flange clamp surrounds and encompasses the annular connection flanges of the pump and the motor. The flange clamp includes an internal geometry cooperating with the beveled edges on the annular connection flanges to securely retain the connection flanges in fixed relation to one another to create a mechanical face seal between the opposing end surfaces of the pump and motor. The flange clamp preferably includes a pair of arcuate clamping arms which are pivotally supported at one end, such as being connected directly together, or connected through an intermediate arcuate arm; and a locking member connecting the other, distal free ends of the arms together. The locking member can be manually tightened and untightened, so that the flange clamp can be easily located around and tightened down around the annular connection flanges of the pump and motor.

Preferably the pump includes a locating geometry, such as an annular raised ridge or surface portion on the forward surface of the connecting flange, which is received within a cooperating circular recess in the mating surface of the motor connecting flange. The locating geometry properly concentrically and axially aligns the motor with respect to the pump. This also allows the pump to be mounted at any rotational orientation with respect to the motor, to facilitate the adaptability of the pump and motor for various applications. Of course, a rotational orientation feature, such as a pin and hole, could be provided if it is important or useful to have the pump mounted at a specific rotational orientation with respect to the motor.

As such, the present invention provides a fluid metering assembly with a flange clamp which provides a simple and easy connection and disconnection of a pump from a motor, and which thereby minimizes the time and labor associated with changing out a pump. The flange clamp of the present invention allows rapid and tool-free connection and disconnection of the pump from the motor.

Further features of the present invention will become apparent to those skilled in the art upon reviewing the following specification and attached drawings.

DETAILED DESCRIPTION OF THE PREFERRED EMBODIMENT

Figure 1:
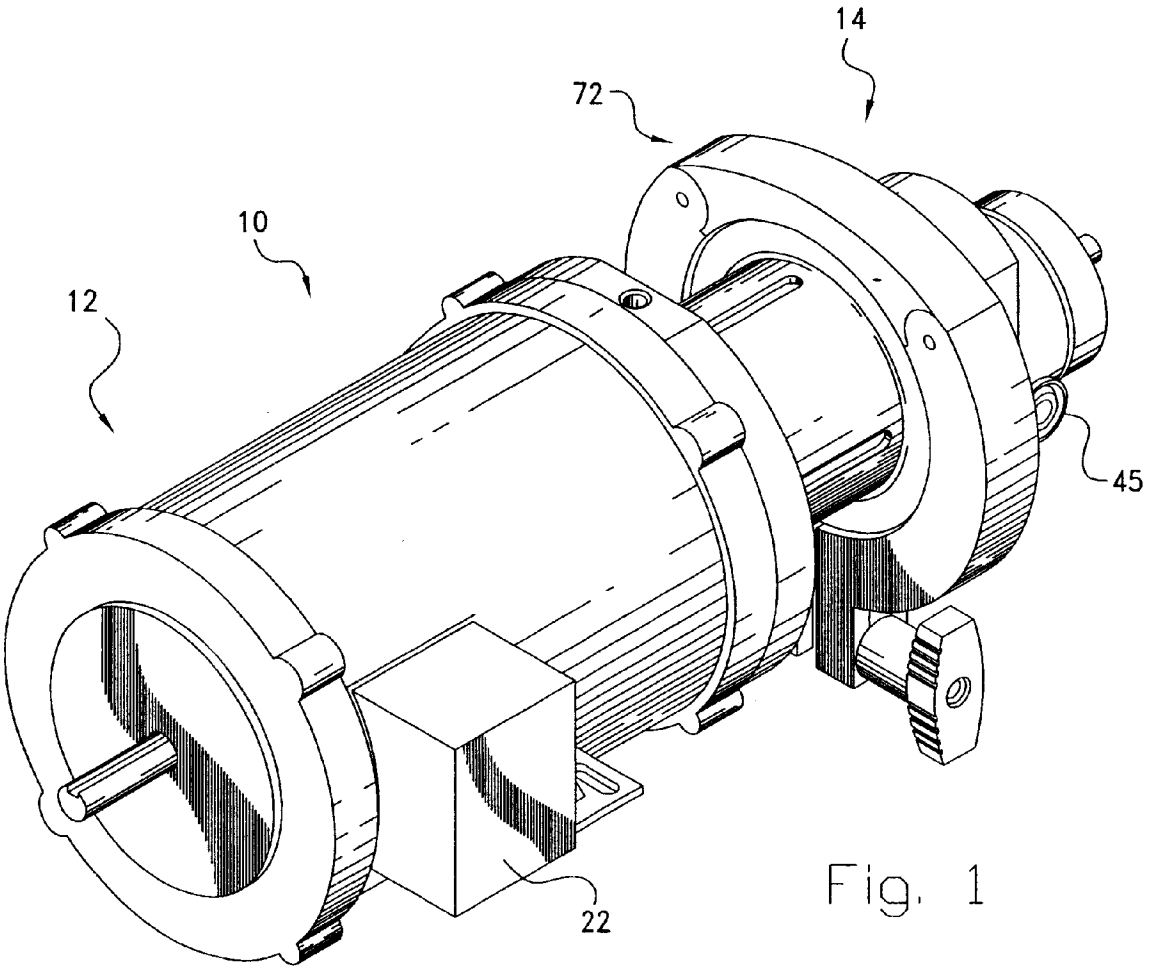
FIG. 1 is an elevated perspective view of a metering assembly constructed according to the principles of the present invention.

Referring to the drawings and initially to FIGS. 1–4, a metering assembly, indicated generally at 10, is shown which is constructed according to the principles of the present invention. The metering assembly 10 includes a motor, indicated generally at 12; and a pump, indicated generally at 14. The motor can be any type of motor appropriate for the particular application, and includes an elongated housing 16 typically supported on a base. The housing 16 encloses an internal drive mechanism (e.g., a rotor and stator), indicated generally at 20, which is controlled and powered, for example, by an electrical connection, indicated generally at 22. A drive shaft 26 is rotatably supported in the housing and coupled to the drive mechanism for rotation therewith. The drive shaft projects outwardly from one end of the motor housing. A sensor (such as a Hall effect sensor—not shown) can be received in an opening 28 to sense the rotation of the drive shaft 26.

A particularly useful motor for the present invention is commercially-available from the Zenith Pumps Division of Parker-Hannifin Corporation, Sanford, N.C., under the mark/designation "ZeDrive", and is a ½ hp DC wet motor; although it should be appreciated that a variety of motors could be used with the present invention, and the above is only an example of one such motor.

The pump 14 is likewise any pump appropriate for the particular application. The illustrated pump comprises a gear pump having a housing 36 enclosing a pair of gears rotatably supported on respective shafts 42, 43. An inlet port 44 and outlet port 45 are provided in the housing. Shaft 42 projects outwardly from the housing as a drive shaft, and can be rotated to operate the gears and transfer fluid from the inlet port 44 to the outlet port 45. The housing 36 typically comprises a series of housing plates 47–49, which are secured together in adjacent relation by bolts 50, although it should be appreciated that the housing could be formed of any number of plates.

A particularly useful pump for the present invention is available from the Zenith Pump Division under the mark/designation C-9000, and has a capacity of 2.4 cc/rev; although again, it should be appreciated that a variety of pumps could likewise be used with the present invention, and the above is only an example of one such pump.

The pump 14 can be coupled to the motor 12 in any appropriate manner, such that the drive shaft 42 of the pump is rotated when the drive shaft 26 of the motor rotates. Such a coupling can be a direct mechanical coupling, or in a preferred embodiment, it can be a magnetic coupling. In this embodiment, an outer magnet assembly 54 is attached to the motor shaft 26; an inner magnet assembly 55 is attached to the pump shaft 42; and a cup-shaped barrier 56 separates the inner magnet assembly from the outer magnet assembly. Such a magnetic coupling assembly is conventional, and should be well-known to those of ordinary skill in the art such that the drive shafts are coupled together without any actual direct mechanical linkage. A flange extension, indicated generally at 57, of the motor housing encloses the magnetic coupling assembly, but this may be absent if a direct mechanical coupling is used.

Figure 2:
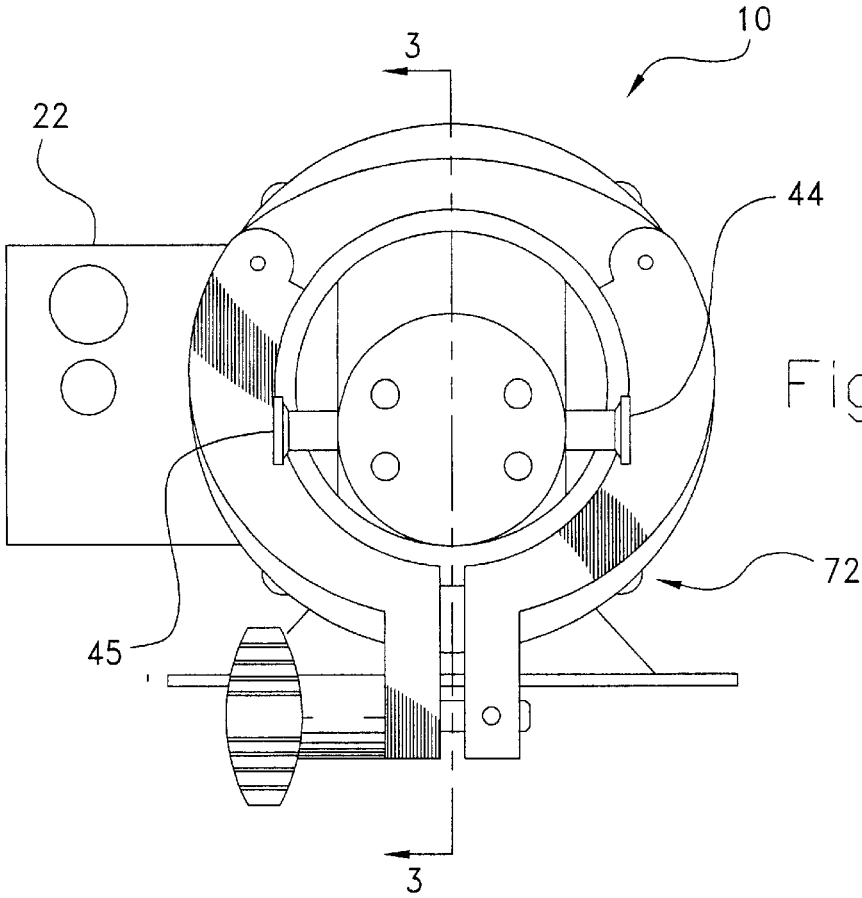
FIG. 2 is a front end view of the metering assembly of FIG. 1.
Figure 5:
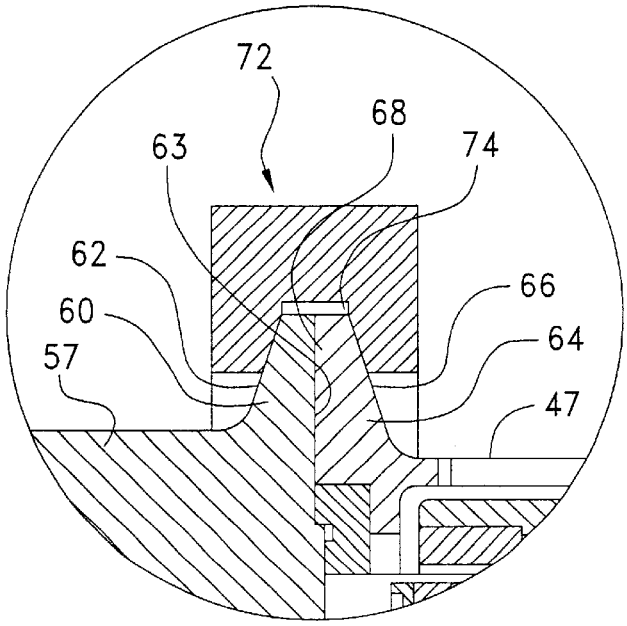
FIG. 5 is an enlarged cross-sectional portion of the pump of FIG. 3.
Figure 3:
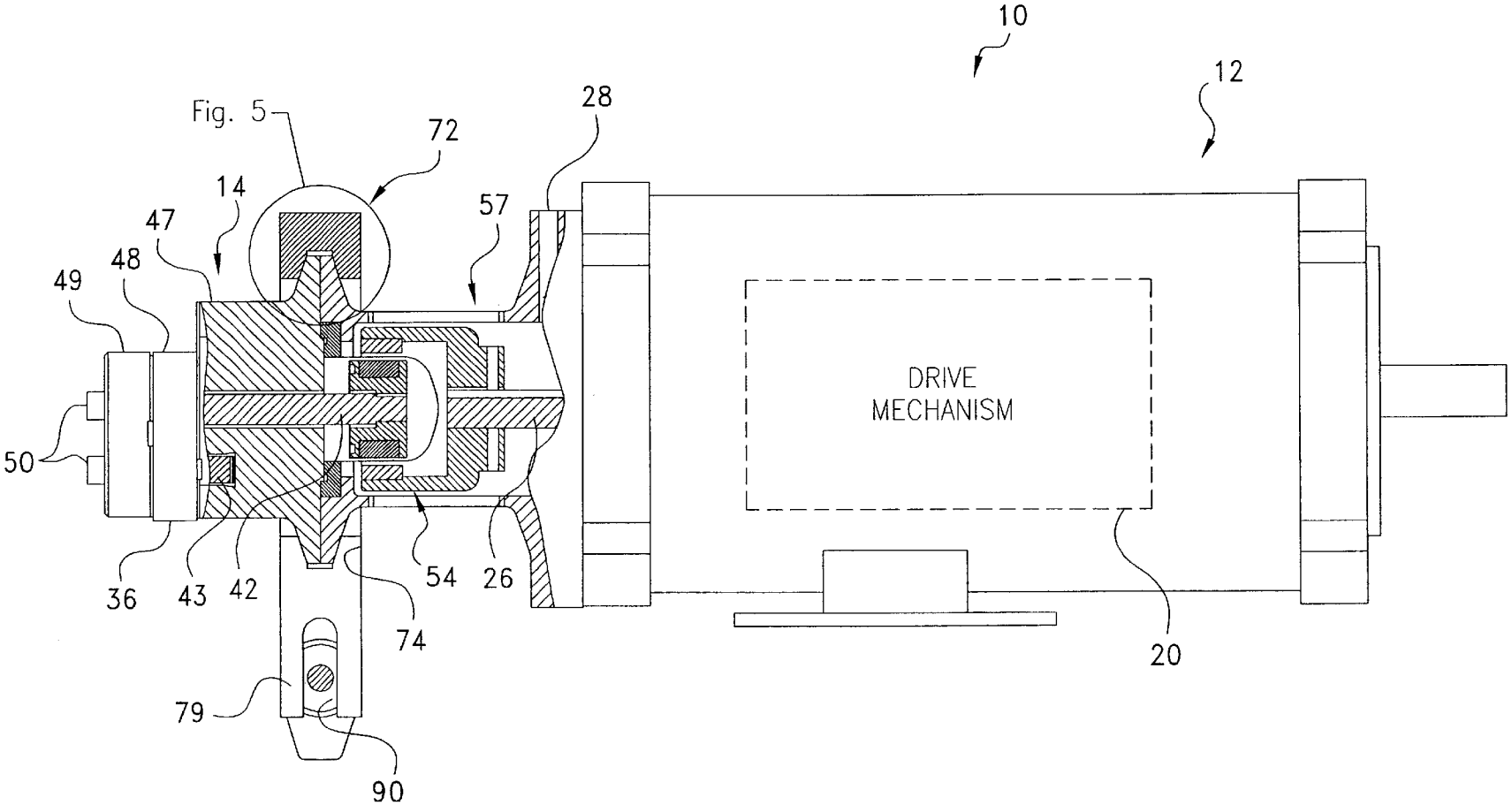
FIG. 3 side view of the metering assembly of FIG. 1, with a portion shown in cross-section along the plane described substantially by the lines 3—3 in FIG. 2.

Both the motor housing and the pump housing include an annular connection flange. As shown in FIG. 2, the motor housing, and more specifically, the flange extension 57 of the motor housing, has a radially outwardly projecting annular connection flange 60, which, as shown in FIG. 5, has a tapered or beveled peripheral edge 62 circumferentially surrounding the flange extension, and a substantially flat end surface 63 extending transverse to the axis of the motor. Likewise, the pump housing, and more particularly the front plate 47 of the pump housing, has a radially outwardly projecting annular connection flange 64, which has a tapered or beveled peripheral edge 66 circumferentially surrounding the pump housing, and a substantially flat end surface 68 extending transverse to the axis of the motor (see also, FIG. 4). The annular connection flanges 60, 64 of the motor and pump are preferably substantially identical, and when the pump is mounted to the motor as described below, the flat forward surfaces 63, 68 mate with each other and provide a flush, mechanically-sealed interface between the motor and the pump.

While not believed necessary in most applications (and not illustrated), sealing rings can be provided between the opposing end surfaces of the connection flanges if desirable to maintain a fluid-tight seal between the pump and motor.

To retain the pump to the motor, a flange clamp, indicated generally at 72 in FIGS. 2–5, is provided. The flange clamp 72 is preferably of the type commonly referred to as a "sanitary flange clamp", and surrounds and encompasses the annular connection flanges 60, 64 of the pump and the motor. The flange clamp includes an internal, wedge or V-shaped geometry 74 (FIG. 5) which receives and preferably substantially matches the beveled edges on the annular connection flanges. When the clamp is tightened, the internal geometry squeezes the edges of the annular connection flanges together to create a secure, mechanical face seal across the end surfaces of the pump and motor.

Figure 4:
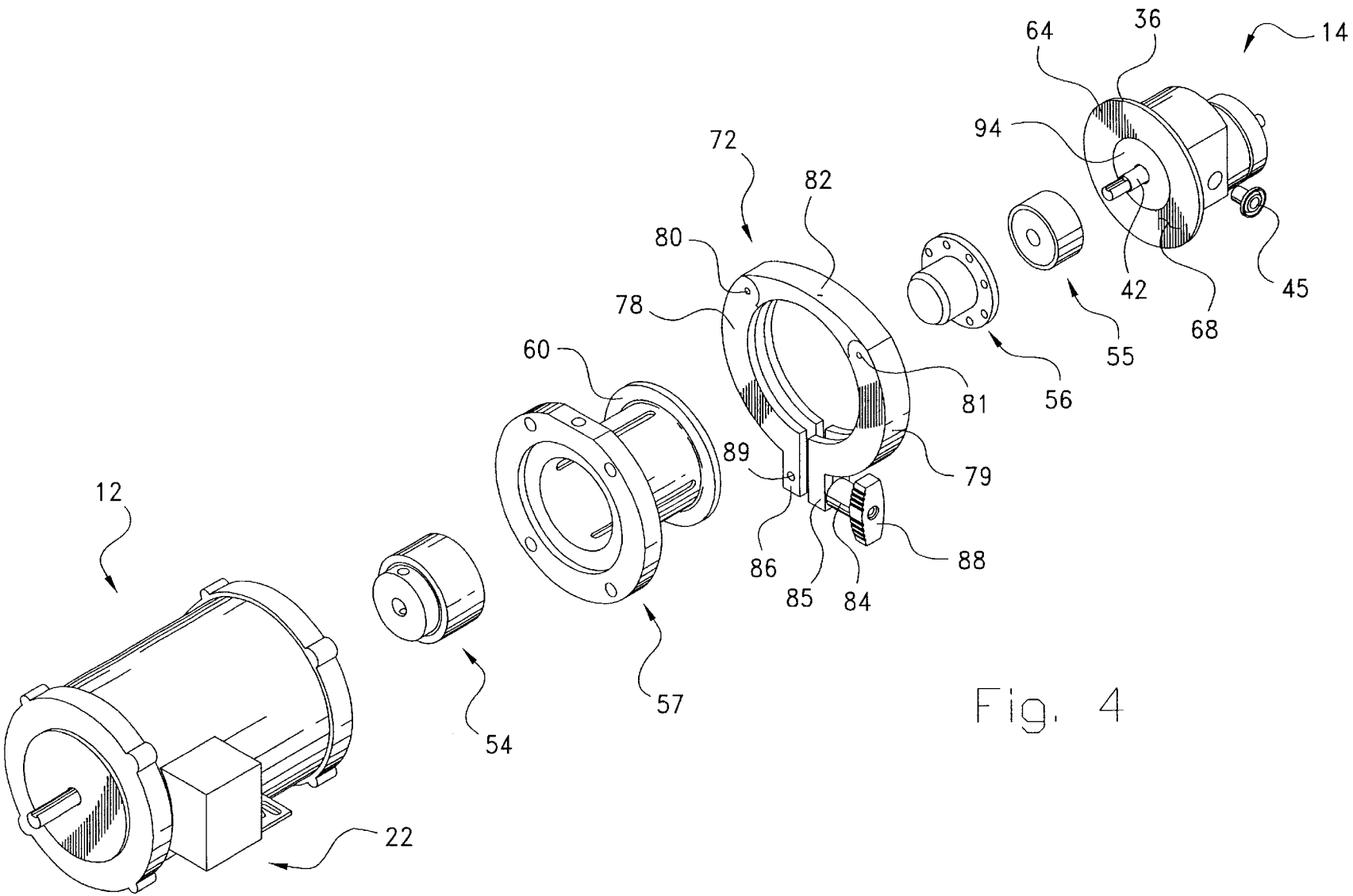
FIG. 4 is an exploded view of the metering assembly.

As shown in FIG. 4, the flange clamp 72 preferably includes a pair of arcuate clamping arms 78, 79 which are pivotally supported at one end 80, 81, such as being connected directly together, or connected through an intermediate arcuate arm 82; and a locking member (wing nut) 84 connecting the other, distal free ends 85, 86, respectively, of the arms together. The locking member 84 has an enlarged end 88, which can be easily grasped to rotate the member, and an opposite end which is pivotally connected as at 89 to the free end 85 of clamping arm 78. A slot (shown at 90 in FIG. 3) on the free end 85 of the other clamping arm 79 can receive the locking member, and the locking member can be manually tightened and untightened in a manner which should be well-known, so that the flange clamp can be enlarged, and easily and rapidly located around the annular connection flanges, and then tightened down around the annular connection flanges to fix the pump to the motor.

A particularly useful flange clamp for the present invention is available from Tri-Clover, Inc. of Kenosha Wash., under the mark/designation 13 MHHS & A13 MHHS; although again, it should be appreciated that a variety of flange clamps could likewise be used with the present invention, and the above is only an example of one such clamp.

Preferably the pump 14 includes a locating geometry, such as an annular raised ridge or surface portion 94 on the forward surface of the connecting flange 64 (see FIG. 4), which is received within a cooperating circular recess (not shown) in the mating surface of the motor connecting flange 60, to properly concentrically and axially align the motor with respect to the pump. This also allows the pump to be mounted at any rotational orientation with respect to the motor, to facilitate the adaptability of the pump and motor for various applications. Of course, a rotational orientation feature, such as a pin and hole (also not shown), could be provided if it is important or useful to have the pump mounted at a specific rotational orientation with respect to the motor.

Thus, as described above, the present invention provides a fluid metering assembly having a flange clamp that provides a simple and easy connection and disconnection of a pump from a motor, and which minimizes the time and labor associated with changing out a pump. The flange clamp of the present invention allows rapid and tool-free connection and disconnection of the pump to the motor.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A metering assembly including a pump and motor for driving the pump, where the pump is a self-contained unit removable from the motor, and includes a housing enclosing a pump mechanism, a fluid inlet and fluid outlet in the housing, and an annular connection flange projecting radially outward from one end of the pump housing; and the motor includes a housing enclosing a drive mechanism, and an annular connection flange projecting radially outward from one end of the motor housing, the annular connection flanges of the motor and pump having flush, mating end surfaces, and coupling means between the motor and the pump for operating the pump mechanism via the drive mechanism, the improvement comprising an annular flange clamp securing the annular connection flange of the pump to the annular connection flange of the motor to create a mechanically sealed interface between the end surfaces of the pump and the motor, and allowing rapid and tool-free connection and disconnection of the pump from the motor, the flange clamp including a pair of arcuate clamping arms, each of which has an internal geometry to receive an arcuate portion of both the annular connection flange of the motor and the annular connection flange of the pump, and which are pivotally connected at one end with respect to each other, and a locking member connecting another distal free end of the arms together, wherein the flange clamp can be radially enlarged and located around the annular connection flanges of the pump and motor, and the locking member tightened to draw the clamping arms together around the annular connection flanges to fix the pump to the motor.

2. The metering assembly as in claim 1, wherein the flange clamp surrounds and encompasses the annular connection flanges of the pump and the motor.

3. The metering assembly as in claim 1, wherein the locking member can be manually engaged to secure the flange clamp to the annular connection flanges of the pump and motor.

4. The metering assembly as in claim 1, wherein the mating end surfaces of the annular connection flanges extend transverse to an axis of the pump and motor.

5. The metering assembly as in claim 1, wherein the end surfaces of the annular connection flanges of the pump and motor have locating geometry, which axially and concentrically aligns the pump with respect to the motor, and which allows the pump to be fixed in any rotational orientation with respect to the motor.

6. The metering assembly as in claim 1, wherein the locking member is pivotally connected to the distal end of one of the clamping arms, and the other of the clamping arms includes a slot to receive the locking member.

7. The metering assembly as in claim 1, wherein the clamping arms of the flange clamp can be manipulated to radially enlarge or reduce the dimension of the flange clamp.

8. A metering assembly including a pump and motor for driving the pump, where the pump is a self-contained unit removable from the motor, and includes a housing enclosing a pump mechanism, a fluid inlet and fluid outlet in the housing, and an annular connection flange projecting radially outward from one end of the pump housing: and the motor includes a housing enclosing a drive mechanism, and an annular connection flange projecting radially outward from one end of the motor housing, the annular connection flanges of the motor and pump having flush, mating end surfaces, and coupling means between the motor and the pump for operating the pump mechanism via the drive mechanism, the improvement comprising a flange clamp securing the annular connection flange of the pump to the annular connection flange of the motor to create a mechanically sealed interface between the end surfaces of the pump and the motor, and allowing rapid and tool-free connection and disconnection of the pump from the motor, wherein the annular connection flanges of the pump and motor each include a beveled peripheral edge, and the flange clamp includes an internal geometry cooperating with the beveled edges to securely retain the annular connection flanges in mechanically sealed relation to one another.

9. The metering assembly as in claim 8, wherein the internal geometry of the flange clamp substantially matches the beveled geometry of the peripheral edges of the annular connection flanges of the pump and motor.

10. A metering assembly including a pump and motor for driving the pump, where the pump is a self-contained unit removable from the motor, and includes a housing enclosing a gear pump mechanism, a fluid inlet and fluid outlet in the housing, and an annular connection flange projecting radially outward from one end of the pump housing; and the motor includes a housing enclosing a drive mechanism, and an annular connection flange projecting radially outward from one end of the motor housing, the annular connection flanges of the motor and pump having flush, transversely-extending mating end surfaces, and coupling means between the motor and the pump for operating the gear pump mechanism via the drive mechanism, and further including an annular sanitary connection flange clamp fixing the annular connection flange of the pump to the annular connection flange of the motor to provide a flush, mechanically-sealed interface between the end surfaces of the pump and the motor, the sanitary connection flange clamp being manually engageable to connect and disconnect the annular connection flanges of the motor and pump, wherein the sanitary connection flange clamp includes arcuate clamping arms, each arm having an internal geometry to receive the annular connection flange of the motor and the annular connection flange of the pump, each arm pivotally supported at one end with respect to each other, and a locking member connecting the other, distal free ends of the arms together, such that the sanitary connection flange clamp can be easily located around and tightened down around the annular connection flanges of the pump and motor.

11. The metering assembly as in claim 10, wherein the sanitary connection flange clamp surrounds and encompasses the annular connection flanges of the pump and the motor.

12. The metering assembly as in claim 10, wherein the end surfaces of the annular connection flanges of the pump and motor have locating geometry, which axially and concentrically aligns the pump with respect to the motor, and which allows the pump to be fixed in any rotational orientation with respect to the motor.

13. The metering assembly as in claim 10, wherein the locking member is pivotally connected to the distal end of one of the clamping arms, and the other of the clamping arms includes a slot to receive the locking member.

14. The metering assembly as in claim 10, wherein the clamping arms of the flange clamp can be manipulated to radially enlarge or reduce the dimension of the flange clamp.

15. A metering assembly including a pump and motor for driving the pump, where the pump is a self-contained unit removable from the motor, and includes a housing enclosing a gear pump mechanism, a fluid inlet and fluid outlet in the housing, and an annular connection flange projecting radially outward from one end of the pump housing: and the motor includes a housing enclosing a drive mechanism, and an annular connection flange projecting radially outward from one end of the motor housing, the annular connection flanges of the motor and pump having flush, transversely-extending mating end surfaces, and coupling means between the motor and the pump for operating the gear pump mechanism via the drive mechanism, and further including a sanitary connection flange clamp fixing the annular connection flange of the pump to the annular connection flange of the motor to provide a flush, mechanically-sealed interface between the end surfaces of the pump and the motor, the sanitary connection flange clamp being manually engageable to connect and disconnect the annular connection flanges of the motor and pump, wherein the annular connection flanges of the pump and motor each include a beveled peripheral edge, and the sanitary connection flange clamp includes an internal geometry cooperating with the beveled edges to securely retain the annular connection flanges in sealed relation to one another.

16. The metering assembly as in claim 15, wherein the internal geometry of the flange clamp substantially matches the beveled geometry of the peripheral edges of the annular connection flanges of the pump and motor.

* * * * *